US008870001B2

(12) United States Patent
Sun et al.

(10) Patent No.: US 8,870,001 B2
(45) Date of Patent: Oct. 28, 2014

(54) MOBILE COUNTERWEIGHT EQUIPMENT OF CRAWLER CRANE AND THE CRANE INCLUDING THE EQUIPMENT

(75) Inventors: Linrui Sun, Shanghai (CN); John Lanning, Shanghai (CN); Liangjian Li, Shanghai (CN); Biwen Qiu, Shanghai (CN); Hua Wan, Shanghai (CN); Hui Guo, Shanghai (CN)

(73) Assignee: Shanghai Sany Science and Technology Co., Ltd, Shanghai (CN)

( * ) Notice: Subject to any disclaimer, the term of this patent is extended or adjusted under 35 U.S.C. 154(b) by 91 days.

(21) Appl. No.: 13/696,718

(22) PCT Filed: Apr. 11, 2012

(86) PCT No.: PCT/CN2012/073752

§ 371 (c)(1),
(2), (4) Date: Nov. 7, 2012

(87) PCT Pub. No.: WO2013/060121

PCT Pub. Date: May 2, 2013

(65) Prior Publication Data

US 2013/0161278 A1 Jun. 27, 2013

(51) Int. Cl.
*B66C 23/76* (2006.01)

(52) U.S. Cl.
CPC ..... *B66C 23/76* (2013.01)
USPC ..... 212/197; 212/178

(58) Field of Classification Search
CPC ..... B66C 23/76
USPC ..... 212/178, 195–198
See application file for complete search history.

(56) References Cited

U.S. PATENT DOCUMENTS

| | | | | |
|---|---|---|---|---|
| 3,777,900 | A * | 12/1973 | Brewer | 212/197 |
| 4,729,486 | A * | 3/1988 | Petzold et al. | 212/302 |
| 5,941,401 | A * | 8/1999 | Petzold et al. | 212/178 |
| 6,279,764 | B1 * | 8/2001 | Stoof | 212/177 |
| 7,037,006 | B2 * | 5/2006 | Chapman | 396/428 |
| 7,128,479 | B2 * | 10/2006 | Chapman | 396/428 |
| 7,311,452 | B2 * | 12/2007 | Chapman | 396/428 |
| 2011/0031202 | A1 * | 2/2011 | Pech et al. | 212/178 |
| 2013/0112642 | A1 * | 5/2013 | Pech et al. | 212/197 |
| 2013/0292352 | A1 * | 11/2013 | Zhang et al. | 212/197 |

FOREIGN PATENT DOCUMENTS

| | | |
|---|---|---|
| CN | 201292224 Y | 8/2009 |
| RU | 2081645 C1 | 6/1997 |

* cited by examiner

*Primary Examiner* — Emmanuel M Marcelo
(74) *Attorney, Agent, or Firm* — Renner, Otto, Boisselle & Sklar, LLP

(57) ABSTRACT

Provided is a mobile counterweight equipment of crawler crane, which includes a main platform, wherein the said mobile counterweight equipment further includes a pair of sliding rails on two sides of the main platform, a slider and counterweight equipment on the sliding rails; the counterweight equipment is connected to the slider, the slider sliding back and forth on the sliding rails. Accordingly, total weight of the counterweight is greatly reduced, the structure is simplified and it is easy to operate and to maintain.

11 Claims, 3 Drawing Sheets

MOBILE COUNTERWEIGHT EQUIPMENT OF CRAWLER CRANE AND THE CRANE INCLUDING THE EQUIPMENT

This application is a national phase of International Application No. PCT/CN2012/073752 filed Apr. 11, 2012, which claims priority to CN 20111033288.5 filed Oct. 28, 2011.

FIELD OF THE INVENTION

The present invention discloses a crawler crane, especially a mobile counterweight equipment of crawler crane and the crane including the equipment.

BACKGROUND OF THE INVENTION

Known crawler crane is a mobile crane which installs the lifting operational part on the track chassis and moves by means of crawlers. It can be used to do such works as lifting, transportation, loading/unloading and installation. Crawler crane has the advantages in good lifting ability, low ground pressure, small turning radius, good climbing ability, without landing leg, ability of driving with load, good working stability and freedom in replacement of the height of the girder assembly. It has a wide range of application in construction industry such as electricity project, municipal works, bridges, petrochemical project, water conservancy and hydropower, etc.

The crawler crane needs to be used in conjunction with the counterweight equipment to balance the load according to the lever balance principle, so that the crawler crane may prevent from overturn when it works. The existing counterweight equipment of crawler crane is generally immovable. The crawler crane balances the load by increasing or reducing the weight of the counterweight in order to change counterweight moment of force of the counterweight equipment. In this situation, it is inevitable for the crawler crane to carry large amounts of counterweight. At the same time, it also requires tedious operation when changing the moment of force of the counterweight, which limits the application of the crawler crane, increases the difficulty of the operation and increases the risk of the misoperation.

Therefore, then a crawler crane with a movable counterweight equipment is put forward, such as the technical solution disclosed in "the movable counterweight equipment of crawler crane" (China Patent Publication No. CN20129224Y). Referring FIG. 1, wherein the counterweight equipment 200 is hung beneath the A-frame 9, it controls the distance between the counterweight equipment 200 and the main platform 100 through a drawstring 8, which connects between the main platform 100 and the counterweight 200. However, as the counterweight 200 is hung beneath the A-frame 9, this solution will make the counterweight 200 instable and swing, thus result in unplanned change of the moment of force of the counterweight and unpredictable danger.

SUMMARY OF THE INVENTION

In order to solve the above mentioned problems of the conventional counterweight equipment of crawler crane, the present invention provides a mobile counterweight equipment of crawler crane and crane including the equipment.

The technical solution adopted by the present invention that solves the technical problems is as follows:

A mobile counterweight equipment of crawler crane, includes a main platform, wherein the said mobile counterweight equipment further includes a pair of sliding rails on both sides of the main platform, slider means and counterweight equipment on the said sliding rails; the said counterweight equipment is connected to the said slider means, the said slider means slides back and forth on the said sliding rails.

As to the above mentioned mobile counterweight equipment of crawler crane, wherein the said mobile counterweight equipment further includes a rear bracket, the said rear bracket is connected to the rear end of the said main platform, the said sliding rail is a support beam; the top of the said support beam is connected to the front portion of the main platform, the end of the said support beam rest on the said rear bracket.

As to the above mentioned mobile counterweight equipment of crawler crane, wherein the said slider means is a pair of trolleys with wheels, the said pair of trolleys set respectively in the said a pair of support beam.

As to the above mentioned mobile counterweight equipment of crawler crane, wherein the said counterweight equipment further includes counterweights and counterweight tray, the said counterweight tray is connected to the said pair of trolley with wheels and the said counterweight tray is hung vertically beneath the said main platform, the said counterweights are placed on the said counterweight tray.

As to the above mentioned mobile counterweight equipment of crawler crane, wherein the said counterweight equipment further includes driving device, the said driving device is connected to the said trolleys, the said driving device drives the said trolley sliding back and forth along the said support beam.

Among the above mentioned mobile counterweight equipment of crawler crane, wherein the said counterweight tray is mainly composed of several identical trays.

Among the above mentioned mobile counterweight equipment of crawler crane, wherein the said driving device is an oil cylinder. One end of the said oil cylinder is connected to the said trolley, while the other end of the said oil cylinder is connected to the said main platform.

Among the above mentioned mobile counterweight equipment of crawler crane, wherein the said trolleys include moving part, the said moving part is caterpillar band, the said trolley slides back and forth on the said support beam by means of the said caterpillar band.

Among the above mentioned mobile counterweight equipment of crawler crane, wherein the said pair of sliding rails are connected to the main platform through a connection part, the said connection part is a pair of foldable elements, the said pair of foldable elements are respectively connected to the two sides of the main platform, the said pair of sliding rails are connected to the said foldable elements when the foldable elements are open.

Among the above mentioned mobile counterweight equipment of crawler crane, wherein each of the said pair of sliding rails includes a telescopic means, the telescopic means allows the said sliding rails stretch out to the rear of the said main platform.

A crawler crane, wherein it includes any one of the above mentioned mobile counterweight equipment of crawler crane.

The beneficial effects of the present invention are:

The total weight of the counterweight is greatly reduced; the structure is simplified and it is easy to operate and to maintain.

DETAILED DESCRIPTION OF THE PREFERRED EMBODIMENT

The present invention will be further illustrated in combination with the drawings and embodiments, however, it shall be appreciated that they are not used to limit the present invention.

Figure 1:
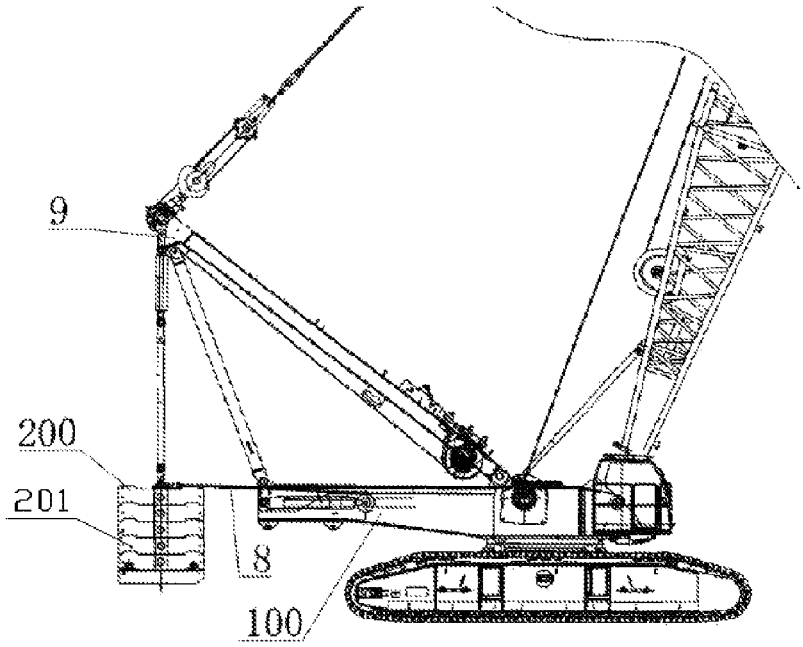
Figure 1 Prior Art
FIG. 1 is a structure schematic of the existing mobile counterweight equipment of the crawler crane.
Figure 2:
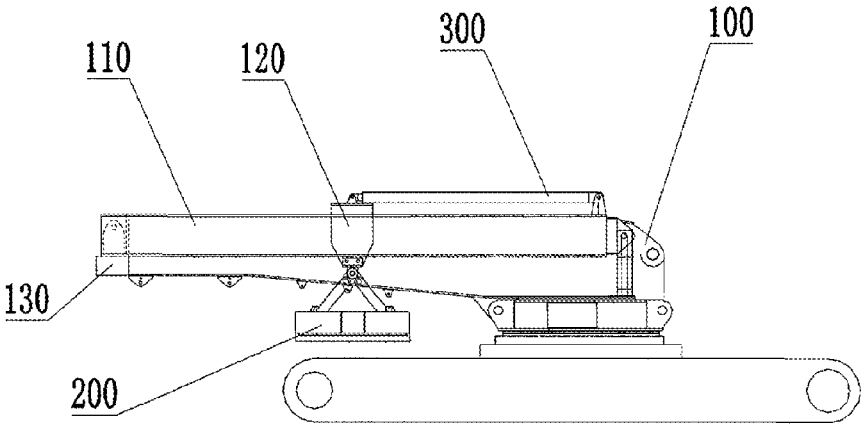
FIG. 2 is a structure schematic of the mobile counterweight equipment of the crawler crane according to the present invention.
Figure 3:
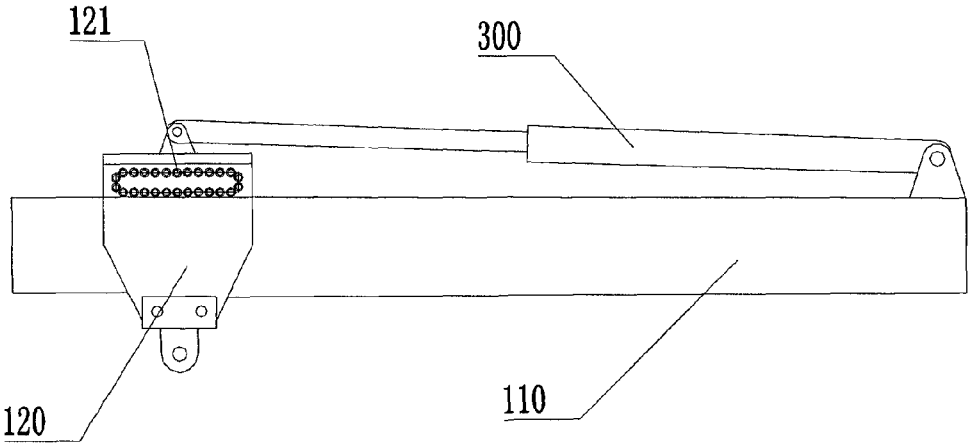
FIG. 3 is a structure schematic of the sliding rails and slider means of the mobile counterweight equipment of the crawler crane according to the present invention.

As shown in FIG. 2 and FIG. 3, the present invention is a mobile counterweight equipment of crawler crane, includes a main platform 100, further includes a pair of sliding rails 110 on two sides of the main platform, slider means 120 and counterweight equipment 200 on the sliding rails 110; the counterweight equipment 200 is connected to the slider means 120, the slider means 120 slides back and forth on the sliding rails 110. The mobile counterweight equipment further includes a rear bracket 130, the rear bracket 130 is connected to the rear end of the main platform 100; the sliding rails 110 could be a support beam; the top part of the support beam, which works as the sliding rails 110, is connected to the front portion of the main platform 100; the end of the support beam rests on the rear bracket 130. The slider means 120 could be a pair of trolleys with wheels. The said pair of trolleys, which work as the slider means 120, set respectively in a pair of support beams.

The working principle of the present invention is: driving the counterweight equipment 200 which is connected with slider means 120 to generate relative displacement with main platform 100 by a pair of trolleys which works as slide equipment 120 and slide back and forth on a pair of support beams which works as sliding rails 110, thus achieve the movement of counterweight.

Furthermore, the counterweight equipment includes a driving device 300, the driving device 300 is connected to the trolleys which work as slider means 120, and the driving device 300 drives the trolleys which work as slider means 120 to slide back and forth along the support beam which work as sliding rails 110. On that basis, the driving device 300 could be an oil cylinder, one end of the oil cylinder which work as the driving device 300 is connected to the trolleys which work as the slider means 120, the other end of the oil cylinder is connected to the main platform 110. An oil cylinder can be connected to a pair of trolleys which work as slider means 120 through a connection element. Alternatively, two oil cylinders are respectively connected to a pair of trolleys which work as slider means 120.

Furthermore, trolleys which work as slider means include moving part 121, the moving part 121 could be the caterpillar band. The trolleys which work as slider means slide back and forth on the said support beam which work as sliding rail 110 by means of the caterpillar band. Selecting caterpillar band as moving part 121 may guarantee the contact area between trolley which work as slider means 120 and the support beam which work as sliding rails 110 to bear stress evenly, therefore it can prevent the moving part 121 from wearing out prematurely.

Furthermore, each of the pair of support beams which work as sliding rails 110 includes a telescopic means, the telescopic means allows the support beams which work as sliding rails 110 to stretch out to the rear of the main platform 110. On special occasions, such as exceeding the initial counterweight, the support beams which work as sliding rails 110 could stretch out to the rear of the main platform 110 to increase the counterweight route.

Figure 4:
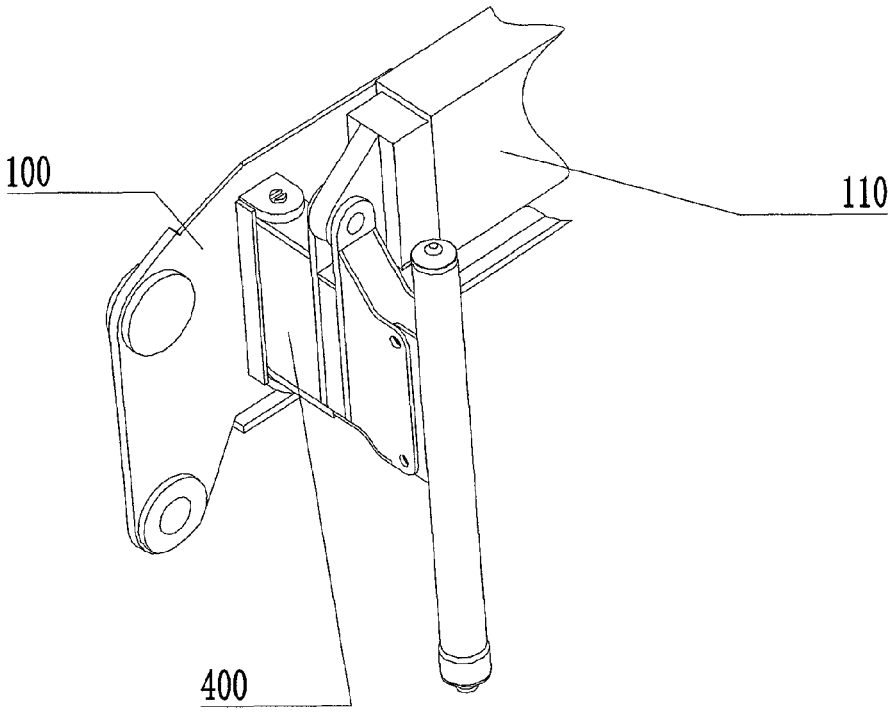
FIG. 4 is a connection structure schematic of the sliding rails and main platform of the mobile counterweight equipment of the crawler crane according to the present invention.

Furthermore, as shown in FIG. 4, a pair of support beams which work as sliding rails 110 are connected to the main platform 100 through a connection part 400, the connection part 400 is a pair of foldable elements, the pair of foldable elements which work as connection part 400 are respectively connected to the two sides of the main platform 110, a pair of support beams which work as sliding rails 110 is connected to the foldable elements 400 when the foldable elements are open. The support beams which work as sliding rails 110 can be removed and the foldable elements which work as connection part 400 can be folded away after use in order to meet the restriction of width under certain transport conditions.

Figure 5:
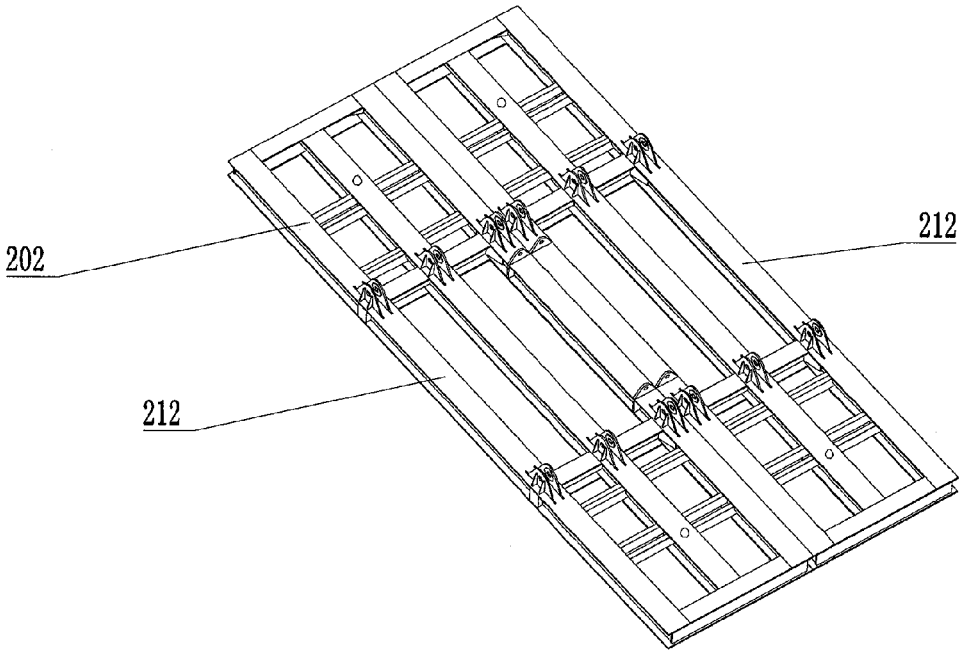
FIG. 5 is a structure schematic of the counterweight tray of the mobile counterweight equipment of the crawler crane according to the present invention.

Furthermore, the counterweight equipment 200 includes counterweights 201 and counterweight tray 202, counterweight tray 202 is connected to the pair of trolleys which work as slider means 120 and counterweight tray is hung vertically beneath the main platform 100, counterweights 201 are placed on the counterweight tray 202. It is convenient to configure the increment and decrement of counterweight by using counterweight tray 202. On that basis, as shown in FIG. 5, the counterweight tray is mainly composed of several identical trays. It can achieve appropriate counterweight 201 space by increasing or decreasing the number of the counterweight trays when there is a need for different weight.

The present invention also includes a crawler crane which includes the above mentioned mobile counterweight equipments. As only the mobile counterweight equipment of the crawler crane is different from the existing technology, the other parts of the crawler crane are not illustrated, the skilled in the art could understand the structure of other parts of the crawler crane which includes the above mentioned mobile counterweight equipment according to the existing technology. Therefore, they are not further introduced herein.

In summary, the total weight of the counterweight is greatly decreased in the mobile counterweight equipment of crawler crane of the present invention. The structure of the present invention is simple and it is easy to operate and to maintain. The text above is only the preferred embodiments of the present invention, not for limiting the patent application range of the present invention. Therefore any modifications according to the descriptions and figures of the present invention that have equal effect is under the scope of protection of the present invention.

The invention claimed is:

1. A mobile counterweight equipment of a crawler crane, which includes a main platform, wherein the mobile counterweight equipment further includes a pair of sliding rails on two sides of the main platform, a slider and counterweight equipment on the sliding rails, the counterweight equipment being connected to the slider, the slider sliding back and forth on the said sliding rails; wherein the pair of the sliding rails are connected to the main platform through a connection part, the connection part being a pair of foldable elements, the pair of foldable elements being respectively connected to the two sides of the main platform, the pair of sliding rails being connected to the foldable part when the foldable part is open.

2. The mobile counterweight equipment of crawler crane according to claim 1, further including a rear bracket, wherein the main platform includes a rear end and a front portion, the support beams include a top part and an end, wherein the rear bracket is connected to the rear end of the main platform, the sliding rails are support beams, and the top part of the support beams is connected to the front portion of the main platform, while the end of the support beam rests on the rear bracket.

3. The mobile counterweight equipment of crawler crane according to claim 2, wherein the slider is a pair of trolleys with wheels, the pair of trolleys set respectively in the pair of support beams.

4. The mobile counterweight equipment of crawler crane according to claim 3, wherein the counterweight equipment further includes counterweights and a counterweight tray, the counterweight tray is connected to the pair of trolleys with wheels and the counterweight tray is hung vertically beneath the main platform, and wherein the counterweights are placed on the counterweight tray.

5. The mobile counterweight equipment of crawler crane according to claim 4, wherein the counterweight tray is composed of several identical trays.

6. The mobile counterweight equipment of crawler crane according to claim 3, wherein the counterweight equipment further includes a driving device, the driving device is connected to the trolleys, and wherein the driving device drives the trolley sliding back and forth along the support beam.

7. The mobile counterweight equipment of crawler crane according to claim 6, wherein the driving device is an oil cylinder, one end of the oil cylinder is connected to the trolley, while the other end of the oil cylinder is connected to the main platform.

8. The mobile counterweight equipment of crawler crane according to claim 6, wherein the trolley includes a moving part, the moving part is a caterpillar band, and wherein the trolley slides back and forth on the support beam by means of the said caterpillar band.

9. A crawler crane including the mobile counterweight equipment of claim 1.

10. A mobile counterweight equipment of a crawler crane, which includes a main platform, wherein the mobile counterweight equipment further includes a pair of sliding rails on two sides of the main platform, slider and counterweight equipment on the sliding rails, the counterweight equipment is connected to the slider, the slider sliding back and forth on the sliding rails, further including a rear bracket, wherein the main platform includes a rear end and a front portion, the support beams include a top part and an end, wherein the rear bracket is connected to the rear end of the main platform, the sliding rails are support beams, and the top part of the support beams is connected to the front portion of the main platform, while the end of the support beam rests on the rear bracket, wherein the slider is a pair of trolleys with wheels, the pair of trolleys set respectively in the pair of support beams, and wherein the counterweight equipment further includes counterweights and a counterweight tray, the counterweight tray is connected to the pair of trolleys with wheels and the counterweight tray is hung vertically beneath the main platform, the counterweights are placed on the counterweight tray.

11. A mobile counterweight equipment of a crawler crane, which includes a main platform, wherein the mobile counterweight equipment further includes a pair of sliding rails on two sides of the main platform, slider and counterweight equipment on the sliding rails, the counterweight equipment is connected to the slider, the slider sliding back and forth on the said sliding rails, further including a rear bracket, wherein the main platform includes a rear end and a front portion, the support beams include a top part and an end, wherein the rear bracket is connected to the rear end of the main platform, the sliding rails are support beams, and the top part of the support beams is connected to the front portion of the main platform, while the end of the support beam rests on the rear bracket, wherein the slider is a pair of trolleys with wheels, the pair of trolleys set respectively in the pair of support beams, wherein the counterweight equipment further includes a driving device, the driving device is connected to the trolleys, and wherein the driving device drives the trolley sliding back and forth along the support beam, and wherein the driving device is an oil cylinder, one end of the oil cylinder is connected to the trolley, while the other end of the oil cylinder is connected to the main platform.

* * * * *